United States Patent [19]

Peregudov et al.

[11] 4,224,063

[45] Sep. 23, 1980

[54] METHOD OF USING IRON MODIFIER

[76] Inventors: Lev V. Peregudov, ulitsa Puzakova, 39, korpus 3, kv. 231; Mikhail M. Malashin, ulitsa Liteizina, 74, kv. 30, both of Tula; Anatoly S. Naletov, ulitsa Novo-Cheremushkinskaya, 38, kv. 67, Moscow; Nikolai S. Martynets, Krasnoarmeisky prospekt, 26, kv. 26, Tula, all of U.S.S.R.

[21] Appl. No.: 33,498

[22] Filed: Apr. 26, 1979

Related U.S. Application Data

[62] Division of Ser. No. 873,664, Jan. 30, 1978.

[51] Int. Cl.[2] ..... C22C 33/00; C21C 7/00

[52] U.S. Cl. ..... 75/129; 75/53; 75/58

[58] Field of Search ..... 75/53, 58, 130 R

[56] References Cited

U.S. PATENT DOCUMENTS

| | | | |
|---|---|---|---|
| 3,158,466 | 11/1964 | Muller | 75/58 |
| 3,492,118 | 1/1970 | Mickelson | 75/130 R |
| 3,769,004 | 10/1973 | Barnhardt | 75/58 |

FOREIGN PATENT DOCUMENTS

| | | | |
|---|---|---|---|
| 1223694 | 3/1971 | United Kingdom | 75/129 |

*Primary Examiner*—P. D. Rosenberg

*Attorney, Agent, or Firm*—Fleit & Jacobson

[57] ABSTRACT

An iron modifier containing, percent by weight;

| | |
|---|---|
| Silicon | 25 to 50 |
| Rare-earth metals | 20 to 40 |
| Carbon | 10 to 30 |
| Sulphur | 0.1 to 0.3 |
| Iron | the balance, |

the components being added into liquid iron in the form of a mixture of alloys and foundry coke in the following proportions, percent by weight:

| | |
|---|---|
| silico-mishmetal | 70 to 90 |
| foundry coke | 10 to 30; |

and this mixture is introduced in an amount of from 0.3 to 0.5% by weight.

The modifier according to the present invention makes it possible to produce thin-walled iron castings without the formation of cementite on the surface thereof.

2 Claims, No Drawings

METHOD OF USING IRON MODIFIER

This is a divisional of application Ser. No. 873,664, filed Jan. 30, 1978.

BACKGROUND OF THE INVENTION

The present invention relates to modifiers for iron and methods of using same in ferrous metallurgy, more specifically in foundry practice.

Commonly known in the art is the use of modifiers to be added into liquid iron to minimize the formation of cementite on the surface of castings.

Presence of the layer of white iron on the casting surface hinders its machining and impairs quality of cast iron, since this layer has low physico-mechanical properties.

Accordingly, iron castings are subjected to annealing in thermal furnaces with the view to increase physico-mechanical properties of the superficial layer of cast iron and improve machinability thereof.

Annealing of iron castings makes possible to increase mechanical properties of the superficial layer and improve machinability of castings, however, on the account of impaired characteristics of the base metal and higher production costs of castings.

British Pat. No. 1,223,694 discloses an additive comprising a mixture of ferrosilicium and rare-earth metals taken in the following proportions, percent by weight:

| | |
|---|---|
| ferrosilicium | 90 to 100 |
| rate-earth metals | 0 to 10. |

This additive, however, does not make possible to obtain iron castings with a wall thickness of below 2 mm, using sand-loam molds.

Lack of an iron modifier which would make it possible to manufacture iron castings without the formation of cementite on the surface of cast iron does not provide for a reduced power consumption in annealing furnaces, or reduced costs of auxiliary equipment and operation personnel

SUMMARY OF THE INVENTION

It is the main object of the present invention to provide an iron modifier which would make it possible to produce thin-walled iron castings in sand-loam molds.

It is another object of the invention to provide a method of using the modifier so as to improve quality of iron castings.

Still another object of the invention is to improve machinability of thin-walled castings.

It is a further object of the invention to reduce production costs of iron castings through elimination of a high-temperature annealing and related expenditures.

These objects are accomplished by an iron modifier containing silicon and rare-earth metals, wherein, in accordance with the present invention there are additionally incorporated carbon and sulphur, the components being present in the following proportions, percent by weight:

| | |
|---|---|
| silicon | 25 to 50 |
| rare-earth metals | 20 to 40 |
| carbon | 10 to 30 |
| sulphur | 0.1 to 0.3 |

-continued

| | |
|---|---|
| iron | the balance. |

The amount of silicon in the modifier below the above-indicated lower limit fails to ensure graphitization of a modified iron.

Increasing content of silicon above the upper limit of the before-indicated range results in impaired physico-mechanical properties of iron.

The content of rate-earth metals below the above-indicated lower limit fails to ensure graphitization of iron.

The content of rare-earth metals above the upper limit of the above-indicated range thereof results in an incrased amount of free cementite in the structure of iron.

Reduced content of carbon and sulphur in the modifier does not ensure the formation of necessary graphite crystallization centres upon hardening of iron.

Increased content of carbon and sulphur in the modifier results in impaired properties of modified iron.

We have found a method of using said iron modifier which contemplates incorporation of said modifier components into liquid iron in the form of a mixture of silico-mishmetal and foundry coke in the following proportions, percent by weight:

| | |
|---|---|
| silico-mishmetal | 70 to 90 |
| foundry coke | 10 to 30. |

The content of the silico-mishmetal in the modifier below the above-mentioned lower limit thereof does not ensure required proportions between silicon and rate-earth metals and an appropriate graphitizing effect thereof.

When the silico-mishmetal is contained in the modifier in an amount exceeding the upper limit of the above-indicated range, the formation of cementite on the surface of cast iron is considerably increased.

When the foundry coke is contained in the modifier in an amount below the lower limit of the above-indicated range, the required number of graphite crystallization centres is not ensured during the process of iron hardening.

Increased content of foundry coke in the modifier results in impaired physico-mechanical properties of a modified iron.

Said modifier is preferably added into liquid iron in an amount ranging from 0.3 to 0.5% by weight.

Addition of the modifier, into liquid iron, in amounts below the above-indicated range does not make it possible to produce thin-walled castings without the formation of cementite on the surface of cast iron in sand-loam molds.

When the modifier is added into liquid iron in an amount exceeding the upper limit of the above-indicated range, physico-mechanical properties of a modified iron are substantially impaired.

DETAILED DESCRIPTION OF THE INVENTION

The present invention is further illustrated by some specific Examples of the modifying agent compositions and method of using same.

EXAMPLE 1

A modifier is prepared which contains, percent by weight:

| | |
|---|---|
| Silicon | 50 |
| rare-earth metals (cerium) | 30 |
| carbon | 10 |
| sulphur | 0.1 |
| iron | the balance. |

EXAMPLE 2

A modifier is prepared which contains, percent by weight:

| | |
|---|---|
| Silicon | 40 |
| rare-earth metals (cerium) | 20 |
| carbon | 30 |
| sulphur | 0.3 |
| iron | the balance. |

EXAMPLE 3

A modifier is prepared containing, percent by weight:

| | |
|---|---|
| Silicon | 30 |
| rare-earth elements (cerium) | 16 |
| carbon | 29 |
| sulphur | 0.3 |
| iron | the balance. |

The properties of iron added with the modifier according to the present invention are shown in the Table hereinbelow.

The modifier according to the present invention contains, percent by weight:

| | |
|---|---|
| Silicon | 25 to 50 |
| Rare-earth metals | 20 to 40 |
| Carbon | 10 to 30 |
| Sulphur | 0.1 to 0.3 |
| Iron | the balance. |

The iron modifier of the present invention possesses a high graphitizing ability.

This is due to the fact that carbon added into iron in the modifier composition does not have time to get completely dissolved. Undissolved submicroscopic particles act as additional crystallization centres thus enhancing the graphitizing effect. Sulphur reacts with the rare-earth elements of the modifier with the formation of high-melting sulphides also acting as additional crystallization centres; as a result, the graphitizing effect of the modifier is enhanced to a greater extent.

The above-mentioned proportions of the ingredients is ensured by that they are incorporated into the modifier in the form of a mixture of silico-mishmetal and foundry coke in the following proportions, percent by weight:

| | |
|---|---|
| silico-mishmetal | 70 to 90 |
| foundry coke | 10 to 30. |

In accordance with the method of the present invention, the modifier is added into liquid iron in the form of the above-mentioned mixture of the alloy and foundry coke.

The graphitizing effect of the modifier is ensured by its content in liquid iron within the range of from 0.3 to 0.5% by weight.

To prepare the modifier according to the present invention, three compositions are produced containing each, percent by weight respectively;

| | |
|---|---|
| silico-mishmetal | 90, 70, 60 |
| foundry coke | 10, 30, 40. |

Each composition is used for modification of iron. For the comparison purposes, modification of iron is simultaneously performed by means of a known modifier. Graphitizing ability of the modifiers is determined by the value of cementite formation of a technological wedge sample in comparison with non-modified iron.

Iron in said technological samples has the following values of cementite formation (see the Table below).

| Modifier | Modifier amount, weight per cent | | | | |
|---|---|---|---|---|---|
| | 0.2 | 0.3 | 0.4 | 0.5 | Non-modified |
| | Cementite formation, mm | | | | |
| Known modifier | 5.2 | 3.9 | 2.8 | 2.1 | 16 |
| Example 1: Silico-mishmetal 90%, foundry coke 10% | 2.5 | 1.5 | 0.0 | 0.0 | 16 |
| Example 2: Silico-mishmetal 70%, foundry coke 30% | 2.9 | 2.0 | 0.5 | 0.0 | 16 |
| Example 3: Silico-mishmetal 60%, foundry coke 40% | 3.5 | 2.2 | 1.2 | 1.0 | 16 |

The modifier composition according to the present invention and the method of using said modifier produce a graphitizing effect which is (as it follows from the above Table) substantially higher than that obtained with a known modifier for the manufacture of iron castings.

With increasing content of the modifier added into iron before the cementite formation value is only insignificantly changed; lowering content of the modifier used earlier does not produce a required effect.

A higher graphitizing ability of the modifier makes it possible to produce thin-walled castings without cementite formation on the surface of cast iron which improves their machinability, eliminates the stage of graphitizing annealing and lowers production costs of castings.

What is claimed is:

1. A method of using a modifier containing in percent by weight:

| | |
|---|---|
| Silicon | 25 to 50 |
| Rare Earth Metals | 20 to 40 |
| Carbon | 10 to 30 |
| Sulphur | 0.1 to 0.3 |
| Iron | the balance, |

comprising the step of adding the components of said modifier into liquid iron in the form of a mixture of silico-mishmetal and foundry coke, the silico-mishmetal comprising the silicon, rare earth metals and iron, the mixture having the following proportions in percent by weight:

| | |
|---|---|
| silico-mishmetal | 70 to 90 |

-continued

| | |
|---|---|
| foundry coke | 10 to 30. |

2. A method as claimed in claim 1, wherein said modifier is added into liquid iron in an amount ranging from 0.3 to 0.5% by weight.

* * * * *